US006260636B1

(12) United States Patent
Cooley et al.

(10) Patent No.: US 6,260,636 B1
(45) Date of Patent: Jul. 17, 2001

(54) ROTARY-TYPE EARTH BORING DRILL BIT, MODULAR BEARING PADS THEREFOR AND METHODS

(75) Inventors: Craig H. Cooley, Bountiful; Wayne R. Hansen, Centerville, both of UT (US); Brian E. Miller, The Woodlands, TX (US); Danny E. Scott, Montgomery, TX (US); Daniel Beeman, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/237,086

(22) Filed: Jan. 25, 1999

(51) Int. Cl.[7] ..... E21B 10/46
(52) U.S. Cl. ..... 175/408; 175/73
(58) Field of Search ..... 175/61, 73, 327, 175/394, 408, 414, 415, 384, 398

(56) References Cited

U.S. PATENT DOCUMENTS

| | | | | |
|---|---|---|---|---|
| 1,644,142 | | 10/1927 | Metzger et al. . | |
| 2,023,266 | | 12/1935 | Davis . | |
| 3,628,616 | | 12/1971 | Neilson . | |
| 3,858,671 | | 1/1975 | Kita et al. . | |
| 4,068,731 | | 1/1978 | Garner et al. . | |
| 4,106,823 | | 8/1978 | Bassinger . | |
| 4,264,246 | * | 4/1981 | Lowis et al. | 175/408 X |
| 4,277,869 | * | 7/1981 | Hartwell | 175/408 X |
| 4,280,742 | | 7/1981 | Justman . | |
| 4,378,852 | | 4/1983 | Garrett . | |
| 4,431,065 | | 2/1984 | Andrews . | |
| 4,512,425 | | 4/1985 | Brock . | |
| 4,545,441 | * | 10/1985 | Williamson | 175/329 |
| 4,552,231 | | 11/1985 | Pay et al. . | |
| 4,726,432 | | 2/1988 | Scott et al. . | |
| 4,762,028 | | 8/1988 | Regan . | |
| 4,815,342 | | 3/1989 | Brett et al. . | |
| 4,884,477 | | 12/1989 | Smith et al. . | |
| 5,004,057 | * | 4/1991 | Tibbitts et al. | 175/408 |
| 5,033,559 | | 7/1991 | Fischer . | |
| 5,058,689 | | 10/1991 | Collinsworth . | |
| 5,074,367 | | 12/1991 | Estes . | |
| 5,119,892 | | 6/1992 | Clegg et al. . | |
| 5,145,016 | | 9/1992 | Estes . | |
| 5,186,268 | | 2/1993 | Clegg . | |
| 5,291,807 | | 3/1994 | Vanderford et al. . | |
| 5,361,859 | * | 11/1994 | Tibbitts | 175/286 |
| 5,467,836 | | 11/1995 | Grimes et al. . | |
| 5,655,612 | | 8/1997 | Grimes et al. . | |
| 5,697,461 | | 12/1997 | Newton et al. . | |
| 5,697,737 | | 12/1997 | Danielsson et al. . | |
| 5,803,194 | | 9/1998 | Rowlett . | |
| 5,806,615 | | 9/1998 | Appleton . | |
| 6,006,845 | * | 12/1999 | Illerhaus et al. | 175/405 |

FOREIGN PATENT DOCUMENTS

| | | |
|---|---|---|
| 2 294 715 | 11/1995 | (GB) . |

* cited by examiner

*Primary Examiner*—Frank Tsay
(74) *Attorney, Agent, or Firm*—Trask Britt

(57) ABSTRACT

An earth boring drill bit including replaceable gage pads. The gage pads and the corresponding surface of the earth boring drill bit may include complementary securing elements which mutually engage one another. The gage pad may be removably affixed to the earth boring drill bit by an affixation element, such as a bolt, a mechanical locking element, brazing, welding, mechanical affixation, or another known technique. The invention also includes a method of testing differently configured gage pads employing a single earth boring drill bit, a method of replacing the gage pads of an earth boring drill bit at the drilling site, a method of customizing an earth boring drill bit to include one or more gage pads of desired configuration, and a method of altering the balance or net imbalance of an earth boring drill bit by replacing at least one gage pad thereof.

68 Claims, 15 Drawing Sheets

ROTARY-TYPE EARTH BORING DRILL BIT, MODULAR BEARING PADS THEREFOR AND METHODS

BACKGROUND OF THE INVENTION

1. Field of the Invention

The present invention relates to replaceable gage pads for rotary-type earth boring drill bits. Particularly, the present invention relates to gage pads that may be removably secured to a rotary-type drill bit. The present invention also relates to modular drill bits which include a bit body and one or more replaceable gage pads securable thereto. Methods of testing different types of gage pads, methods of replacing the gage pads of a drill bit, and methods of altering the balance or net imbalance of a drill bit are also within the scope of the present invention.

2. Background of the Related Art

Conventional rotary-type earth boring drill bits, including drag bits, roller-cone bits, and other drill bits, typically include fixed, integral gage pads or other bearing surfaces that maintain the gage of the bore hole being drilled and prevent whirl and vibration of the drill during drilling.

The cutters of state of the art earth boring drill bits typically resist wear and, thus, may outlast other bit components, such as the gage pads and other bearing surfaces of the drill bit. Thus, while the cutters of a drill bit may continue to effectively drill through a formation, the gage pads may be worn, which may result in vibration of the drill bit during drilling and, therefore, a non-circular bore hole, or well. If the cutters at the gage also become worn, an undergage bore hole, or a bore hole with a smaller diameter than that of a new drill bit employed therein, may result. Reaming of an undergage borehole is typically required to bring the bore hole to full gage, or diameter. Reaming is, however, somewhat undesirable since it necessitates additional drilling time and expense. An undergage bore hole may also damage a new bit during insertion of same into the bore hole. An undergage bore hole may also cause the casing or the drill string to become stuck in the bore hole, necessitating expensive and time consuming remedial operations or the abandonment of expensive drilling equipment.

Thus, when a drill bit is no longer able to drill a full gage bore hole, the useful life of the drill bit has ended, even if the expensive cutters and other components thereof are still useful.

Similarly, in order to test a new type of gage pad, a gage pad with a particular type of surface, a particular gage pad configuration, or a gage pad that includes new features or components, it is typically necessary to fabricate a separate prototype drill bit for each variation in the tested gage pads. Thus, the testing of different types of gage pads may be very costly, and a large amount of time may be required to fabricate each prototype drill bit.

Moreover, although the tested gage pads of the prototype drill bit may not be useful for their intended purpose, or may otherwise be undesirable, the other components of the prototype drill bit may still have a long, useful life. Nevertheless, the prototype drill bit, along with many of the components thereof, would have to be scrapped. Thus, the drill bit and many of its components, as well as the time required to fabricate the drill bit, are wasted.

A typical bore hole may pass through several types of rock formations. Since different types of earth boring drill bits are designed to drill through only one or a few specific types of formations, more than one type of drill bit may be required to drill the bore hole. As the types of formations that will be encountered as a bore hole is drilled may not be known prior to actually drilling the bore hole, however, the types of drill bits that will be required may also not be known. Accordingly, either several types of drill bits must be on hand at the drilling site, or the drilling operation may cease until the appropriate type of drill bit is delivered to the drilling site.

It may also be desirable to alter the mass balance or net mass imbalance (i.e., the center of gravity) of a drill bit so as to eliminate, reduce, or otherwise counteract unexpected vibration, or "whirl" or cutter force imbalance, that may be encountered during drilling. However, the balance or net imbalance of typical conventional earth boring drill bits may not be altered.

Accordingly, an earth boring drill bit with modular, removeable gage pads is needed to improve the useful life of earth boring drill bits, to reduce or eliminate unwanted vibration of the drill bit during drilling, to facilitate customization of the drill bit at the drilling site, and to reduce testing and drilling costs.

SUMMARY OF THE INVENTION

The modular drill bit and methods of the present invention satisfy each of the foregoing needs.

The modular drill bit of the present invention includes a bit body and at least one gage pad removably securable thereto. The removable gage pad includes a bearing surface, upon which a hardfacing material or inserts may be disposed, and an abutment surface, which is shaped substantially complementary to a corresponding surface of the bit body to which the gage pad is securable.

The bearing surface may include one or more types of hardfacing material disposed thereon in a variety of patterns. Different types of inserts may also be disposed on the bearing surface of the gage pad in a variety of patterns.

The replaceable gage pad may have any thickness, height, width, and configuration that would be useful on an earth boring drill bit or a given configuration.

The abutment surface of the removable gage pad may include a securing element configured to engage a cooperative, complimentarily shaped securing element of the bit body. The securing elements of the gage pad and bit body may include protrusions and complementary receptacles or slots. The removable gage pad may be affixed to the bit body by means of brazing, mechanical affixation, the use of adhesives, by the combination of a bolt, an aperture through the gage pad, and a hole in the bit body threaded complimentarily to the bolt, or by other known techniques.

The present invention also includes methods of using the modular drill bit. A first method includes repairing a modular drill bit. As a gage pad of the modular drill bit wears to an undergage dimension or is damaged, the gage pad may be removed from the drill bit and replaced with an undamaged gage pad of the proper specification. Moreover, if a gage pad or a portion thereof is sheared from the drill bit, the remainder of the gage pad may be removed from the drill bit and a replacement gage pad secured thereto.

The modular drill bit of the present invention is also useful for testing different types of gage pads on a single drill bit. As the gage pads of the present invention are removable and may be replaced with other gage pads, gage pads of a first type may be tested on a drill bit, removed therefrom, and replaced with different gage pads of a second type to be tested. Accordingly, the drill bit and replaceable gage pads of the present invention facilitate the testing of different types of gage pads without requiring the fabrication of as many different prototype drill bits.

Another method in which the drill bit and gage pads of the present invention may be employed includes replacing a first set of gage pads with a second set of gage pads of a different type as the bore hole enters a different type of formation, for example, a harder or more abrasive formation. Accordingly, a single drill bit with replaceable gage pads may be employed to drill through an increased number of formation types.

The present invention also includes a method of customizing a drill bit to include a desired type or desired types of gage pads thereon.

As gage pads of different thicknesses or configurations may be secured to the modular drill bit, the present invention also includes a method of modifying the mass balance or net mass imbalance (i.e., center of gravity) of the drill bit to eliminate, reduce, or otherwise counteract any cutter force imbalance. For example, one or more relatively wider gage pads or gage pads of relatively greater mass may be secured to one side of the drill bit, while narrower gage pads or gage pads of lesser mass are secured to the remainder of the drill bit to create a desired amount of net imbalance. Gage pads of different masses may also be secured to the drill bit in appropriate locations to offset other factors, such as cutter size, location, or orientation, that affect the desired balance or net imbalance of the drill bit.

The present invention similarly includes a method of adjusting the gage of the bit. For example, in some applications, it may be desirable to have the gage of the bit on gage with the bore hole. In other applications, it may be desirable to have the bit gage below the gage of the bore hole. The bit gage depends, in part, upon the steerability requirements of the drill bit. Thus, the gage of the drill bit could be modified by replacing a first set of gage pads with a second set of gage pads having a different thickness.

Other features and advantages of the present invention will become apparent through consideration of the ensuing description, the accompanying drawings, and the appended claims.

DETAILED DESCRIPTION OF THE PREFERRED EMBODIMENTS

Figure 1:
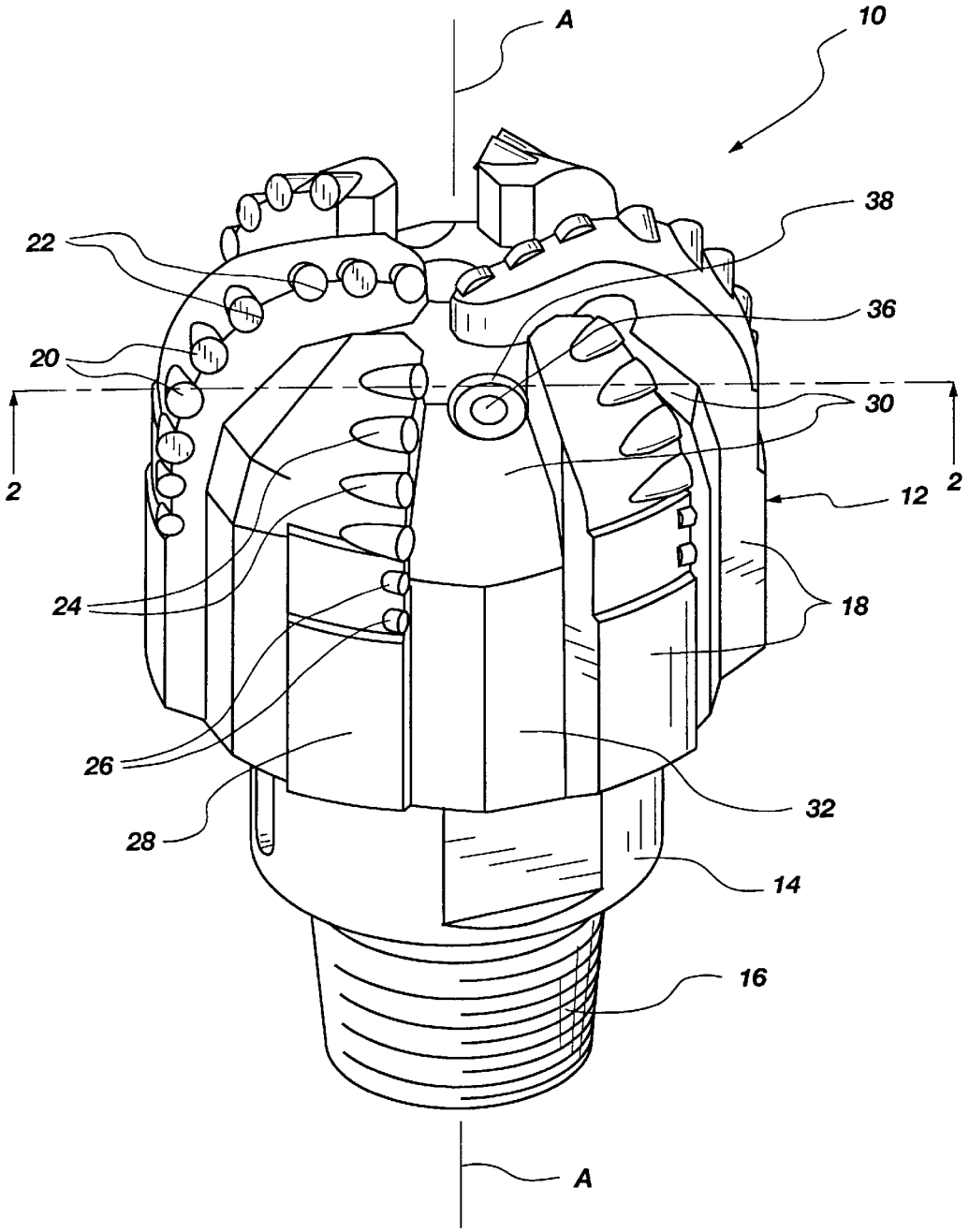
FIG. 1 is a frontal perspective view of an inverted drag type, earth boring drill bit according to the present invention, which includes modular gage pads.
Figure 2:
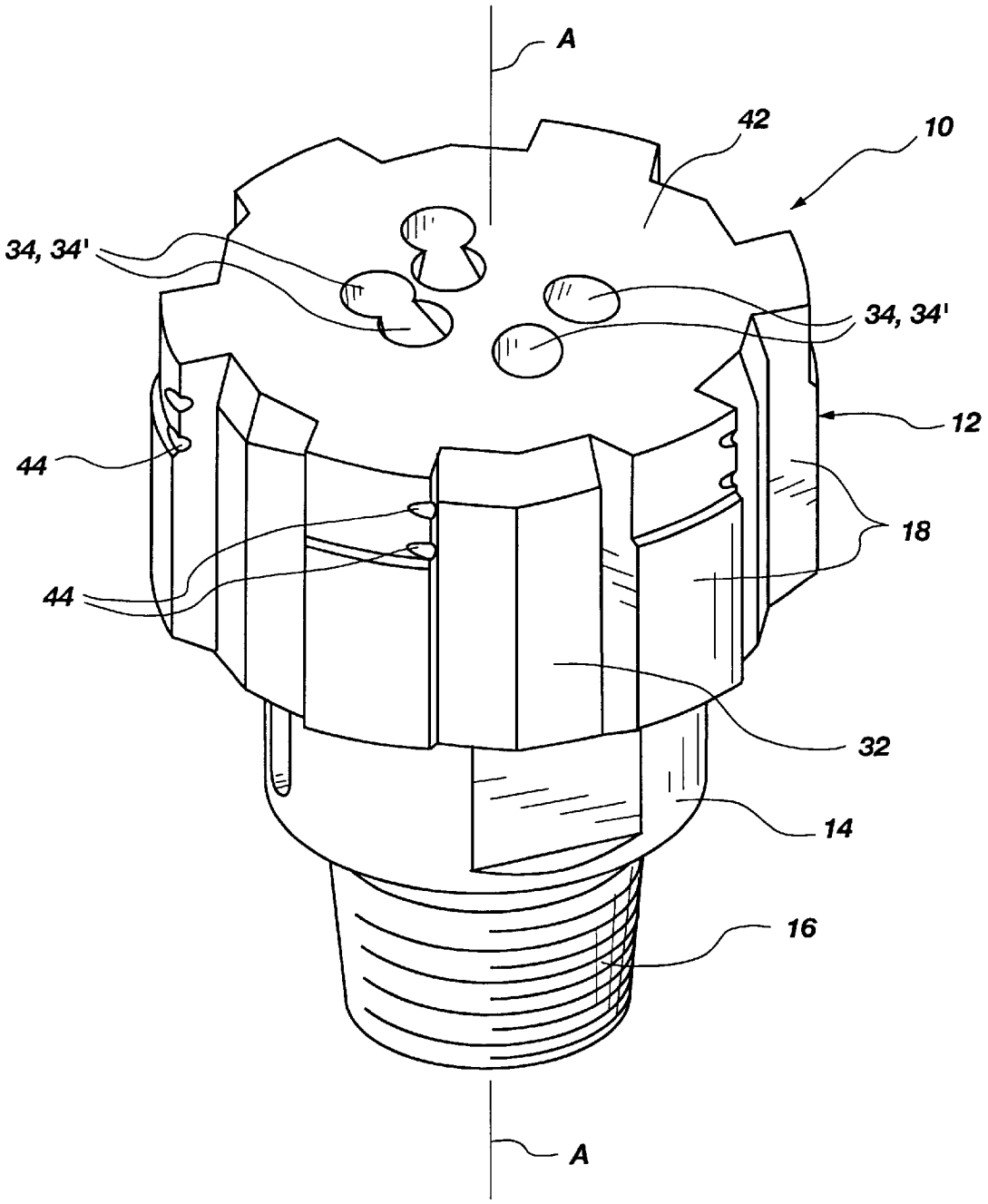
FIG. 2 is a partial frontal perspective view of the inverted drill bit of FIG. 1, illustrating a cross section thereof, taken along line 2-2 of FIG. 1.

With reference to FIGS. 1 and 2 of the drawings, an exemplary drag-type drill bit 10 according to the present invention includes a variety of external and internal components, such as a bit body 12 secured to a tubular bit shank 14 having a threaded pin connection 16 at the free end thereof and six blades or wings 18 carrying cutting elements 20 placed in cutter pockets 22 and supported from the rear by inclined buttresses 24. Gage trimmers 26 are set immediately adjacent and above (as depicted in the drawing figures) gage pads 28. Gage pads 28 are removably secured to bit body 12 by means of a securing element (see FIGS. 3-14B). Blades 18 are separated by generally radially extending fluid courses 30 leading to junk slots 32, fluid courses 30 and junk slots 32 being provided in operation with drilling fluid ("mud") from the drill string through bit shank 14 communicating with internal fluid passages 34 leading to nozzles 36 in cavities 38 opening into fluid courses 30. Blades 18, fluid courses 30 and the topographical details thereof collectively define what may be termed the "bit face", being the surface of the bit in contact with the undrilled formation at the bottom of the borehole. The exterior shape of a diametrical cross-section of the bit body 12 taken along the longitudinal bit axis A defines what may be termed the bit or "crown" profile.

Figure 3:
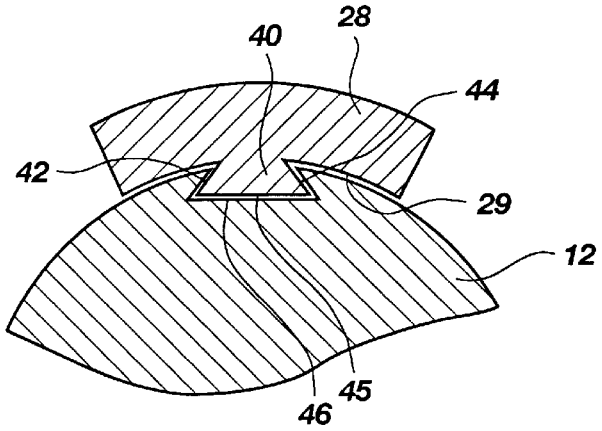
FIG. 3 is a cross section of a removable gage pad secured to a bit body, illustrating mutually engaged securing elements of the gage pad and bit body.
Figure 4:
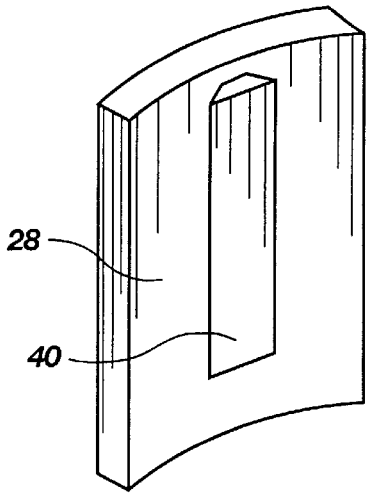
FIG. 4 is a perspective, radially interior view of the gage pad of FIG. 3 depicting a securing element.
Figure 5:
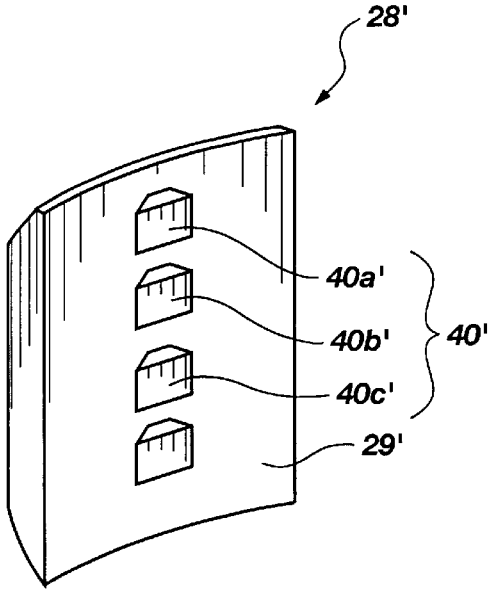
FIG. 5 is a perspective, radially interior view of the gage pad of FIG. 3, with a variation of the securing element of FIG. 4.

With reference to FIGS. 3–5, a first embodiment of gage pad 28 includes a protruding securing element 40 that is complimentarily configured to a cooperating recess or groove securing element 46 of bit body 12. As illustrated, securing element 40 protrudes from an abutment surface 29 of gage pad 28. Preferably, abutment surface 29 is configured to complimentarily abut a corresponding portion of the exterior surface of bit body 12. Securing element 40 may extend longitudinally along the substantial length of gage pad 28, as shown in FIG. 4.

Alternatively, a segmented variation of securing element 40' may include a number of longitudinally aligned protrusions 40*a*', 40*b*', 40*c*', etc. along abutment surface 29', as shown in FIG. 5.

As FIG. 3 illustrates, the opposing sides 42 and 44 of securing element 40 may be non-parallel, and taper outwardly relative to abutment surface 29, such that sides 42 and 44 each form a substantially acute angle with abutment surface 29. Thus, the width of securing element 40 increases from the portion thereof adjacent abutment surface 29 to the posterior surface 45 of the securing element 40.

With continued reference to FIG. 3, the securing element 46 that cooperates with securing element 40 preferably includes an elongated slot extending longitudinally along the face of bit body 12. As illustrated, the transverse cross section of securing element 46 tapers outwardly, such that the distance thereacross increases from the face of bit body 12 to the interior of the bit body. Securing element 46 is configured to secure both an elongated, continuous securing element 40 (FIG. 4) and a segmented, or discontinuous, securing element 40' (FIG. 5).

Gage pad 28 may be secured to bit body 12 by inserting an end of securing element 40 into cooperating securing element 46. The securing element 40 and cooperating securing element 46 mutually engage one another as gage pad 28 and bit body 12 are moved longitudinally relative to each other until securing element 40 preferably abuts a blind end of cooperating securing element 46. Preferably, the end of securing element 46 that abuts securing element 40 is located at the uppermost end (as the bit is oriented during drilling) of cooperating securing element 46 to prevent the longitudinal sliding of gage pad 28 relative to bit body 12 as downward force is applied to the bit 10 during drilling operations.

Figure 6:
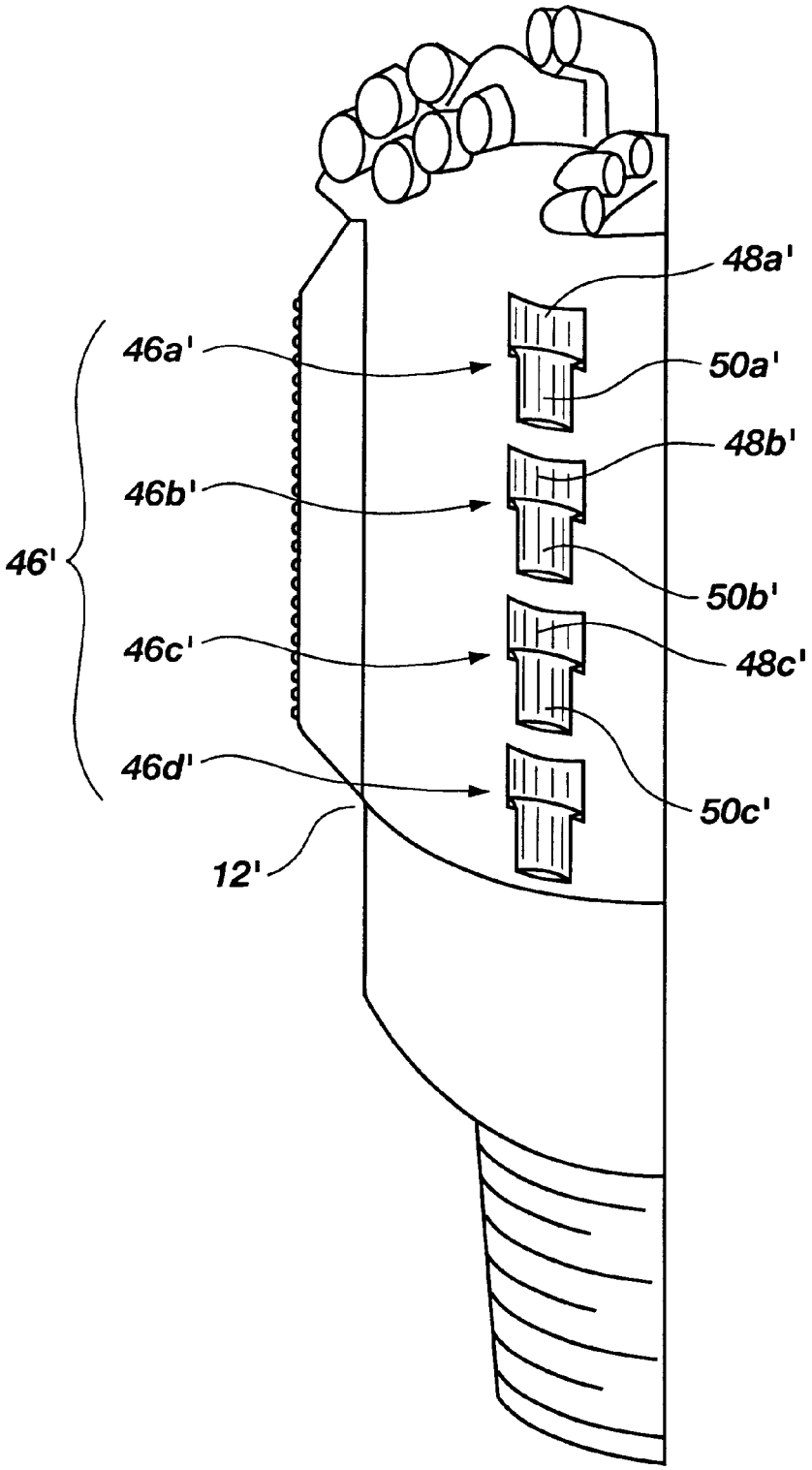
FIG. 6 is a partial perspective view of an inverted drill bit including a variation of the securing element of the bit body of FIG. 3 for cooperative engagement with the securing element of the gage pad of FIG. 5.

Alternatively, as illustrated in FIG. 6, a variation of securing element 46', which is configured to receive and retain a cooperating segmented securing element 40' (FIG. 5), includes a number of slots 46*a*', 46*b*', 46*c*', etc. longitudinally aligned along bit body 12'. Slots 46*a*', 46*b*', 46*c*', etc. correspond to the longitudinally aligned protrusions 40*a*', 40*b*', 40*c*', etc. (FIG. 5), and each include receptacles 48*a*', 48*b*', 48*c*', etc. and retainers 50*a*', 50*b*', 50*c*', etc. Receptacles 48*a*', 48*b*', 48*c*', etc. are configured to receive protrusions 40*a*', 40*b*', 40*c*', etc. Retainers 50*a*', 50*b*', 50*c*', etc. are continuous with receptacles 48*a*', 48*b*', 48*c*', etc. and each has a transverse cross section such as that described above in reference to FIG. 3. Preferably, retainers 50*a*', 50*b*', 50*c*', etc. are positioned above receptacles 48'*a*, 48'*b*, 48'*c*, etc. in order to prevent upward sliding of gage pad 28' (FIG. 5) relative to bit body 12' as downward force is applied to drill bit 10' during drilling operations.

With continued reference to FIGS. 5 and 6, gage pad 28'may be secured to bit body 12' by inserting protrusions 40*a*', 40*b*', 40*c*', etc. into the receptacles 48*a*', 48*b*', 48*c*', etc. of their corresponding slots 46*a*', 46*b*', 46*c*', etc., and moving the gage pad 28' and bit body 12' longitudinally relative to each other until each corresponding protrusion and retainer 50*a*', SO*b*', 50*c*', etc. mutually engage each other.

As desired or required, the cooperating securing elements may be designed with a slight interference fit, or the adjacent surfaces of the cooperating securing elements may be coated with a braze material or adhesive to facilitate a more secure attachment of the gage pad to the bit body. Alternatively, the cooperating securing elements may be welded to one another to secure the gage pad to the bit body.

Figure 7:
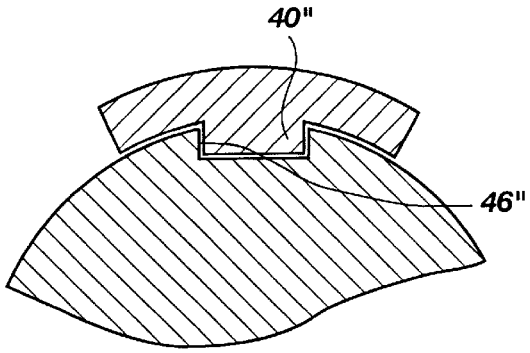
FIGS. 7–10 are cross sections of variations of the gage pad of FIG. 3, with variations of the securing element of FIG. 4.
Figure 8:
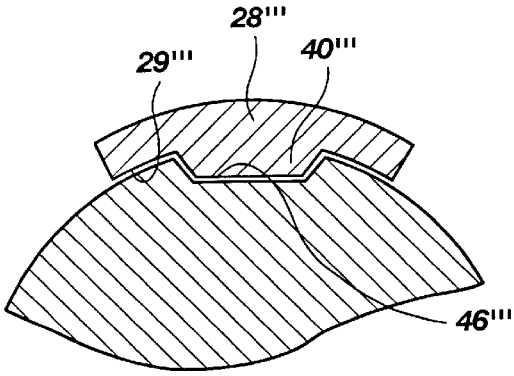

Although the drawing figures illustrate securing elements 40 and 40' as including outwardly tapered protrusions and cooperating securing elements 46 and 46' as including complimentarily outwardly tapered slots, securing elements 40" that have a constant width along the thickness thereof (i.e., do not taper at the sides thereof) and complimentarily configured cooperating securing elements 46", which are illustrated in FIG. 7, are also within the scope of the present invention. As shown in FIG. 8, securing elements 40'" that include inwardly tapered sides, such that the width thereof decreases from the portion adjacent the abutment surface 29' of the gage pad 28'" toward the posterior surface of the securing element 40'", as well as complimentarily configured, cooperating securing elements 46'", are also within the scope of the present invention. With the embodiments of FIGS. 7 and 8, it would be necessary to braze, weld, or adhesively bond the gage pads to the bit body, or to secure the gage pads to the bit body by some other means.

Figure 9:
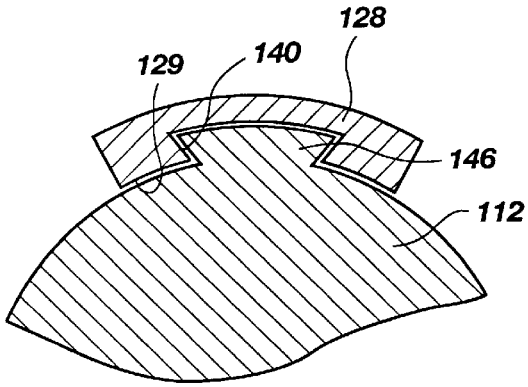

FIG. 9 illustrates yet another variation of the securing element 140 and the cooperating securing element 146, wherein securing element 146 includes a longitudinally oriented protrusion on the face of bit body 112, similar to the variations of the securing element of the gage pad described above in reference to FIGS. 3, 4 and 6–8. A cooperating securing element 140 of a removable gage pad 128 is configured complimentarily to securing element 146, and includes one or more slots oriented longitudinally in the abutment surface 129 of gage pad 128.

Figure 10:
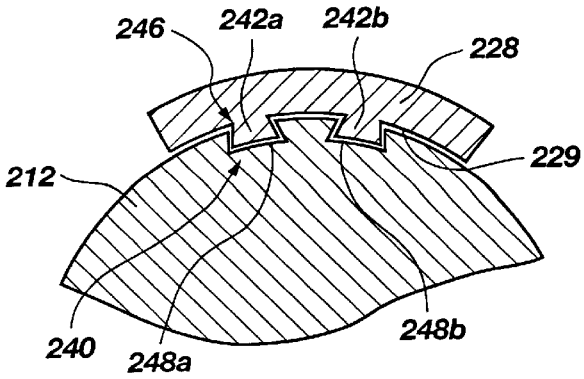

FIG. 10 illustrates yet another variation of the securing element 240 and the cooperating securing element 246 of the present invention, wherein the securing element 240 includes two substantially parallel, longitudinally extending members 242*a* and 242*b*, which are also referred to as protrusions, that protrude from the abutment surface 229 of gage pad 228. The cooperating securing element 246 of bit body 212 includes two substantially parallel, longitudinally extending slots 248*a* and 248*b* formed in bit body 212. Slots 248*a* and 248*b* are configured complimentarily to members 242*a,* and 242*b,* respectively.

Variations of securing element 240 and cooperating securing element 246, such as those described above with reference to FIGS. 3–9, are also within the scope of the present invention, as are the use of more than two protruding members and corresponding slots.

As noted above, in most instances, once a gage pad has been disposed on the bit body, the gage pad may be affixed to the bit body by an affixation element, which may include an interference fit, mechanical affixation, mechanical locking (e.g., by corresponding tabs and slots), brazing, welding, the use of adhesives, the use of bolts, apertures, and complimentarily threaded receptacles formed in the bit body, or other techniques that are known in the art to secure components to a bit body.

Figure 11:
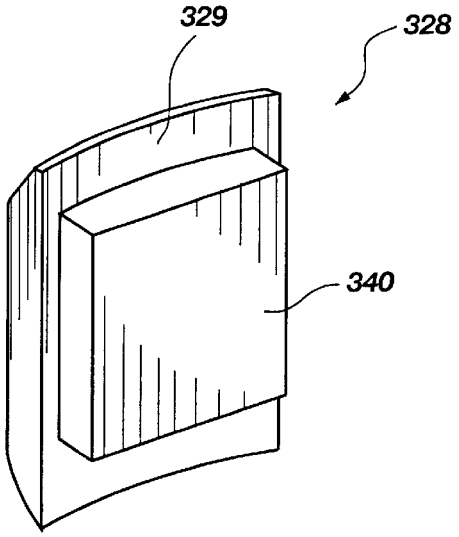
FIG. 11 is a perspective, radially interior view of another embodiment of the removable gage pad, depicting another embodiment of the securing element.
Figure 12:
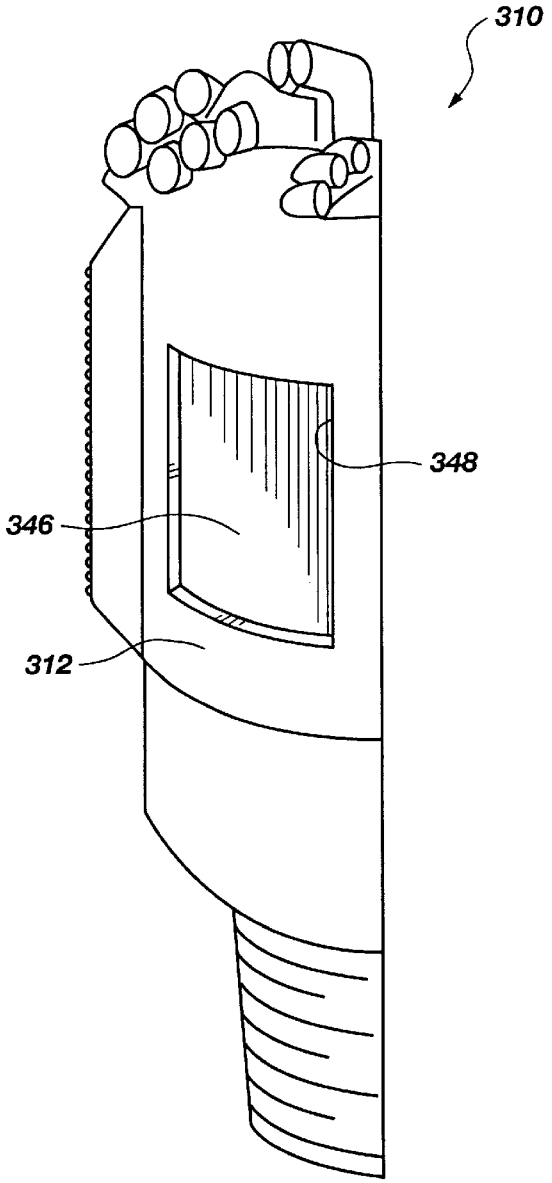
FIG. 12 is a partial perspective view of an inverted drill bit including another embodiment of a securing element for cooperative engagement with the securing element of the gage pad of FIG. 11.

Referring now to FIGS. 11 and 12, another embodiment of gage pad 328 includes a securing element 340 protruding from an abutment surface 329 thereof. A receptacle 346, which is also referred to as a securing element or cooperating securing element, is formed in bit body 312 and configured complimentarily to securing element 340 in order to receive same. Receptacle 346 may include an abutment end 348 that faces in the direction of rotation of drill bit 310. Abutment end 348 prevents gage pad 328 from sliding circumferentially relative to bit body 312 during operation of drill bit 310 and, therefore, prevents the shearing of gage pad 328 from bit body 312 during drilling.

Figure 13:
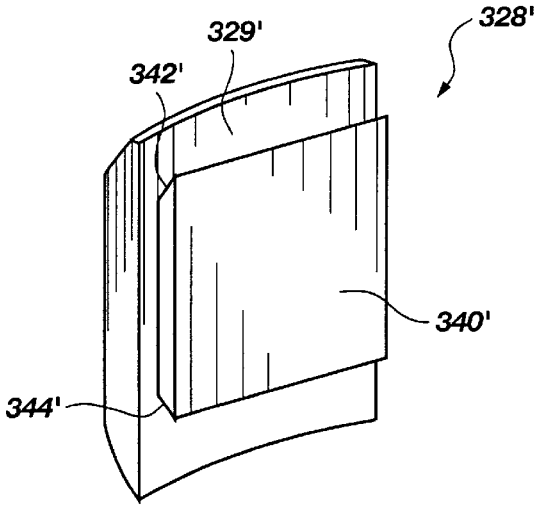
FIG. 13 is a perspective, radially interior view of a variation of the gage pad of FIG. 11, depicting a variation of the securing element.

With reference to FIG. 13, in a variation of the securing element of gage pad 328', the upper and lower edges 342' and 344' of securing element 340' may taper outwardly, such that portions of securing element 340' that are adjacent abutment surface 329' are not as wide as portions of securing element 340' that are more distant from abutment surface 329'.

Figure 13A:
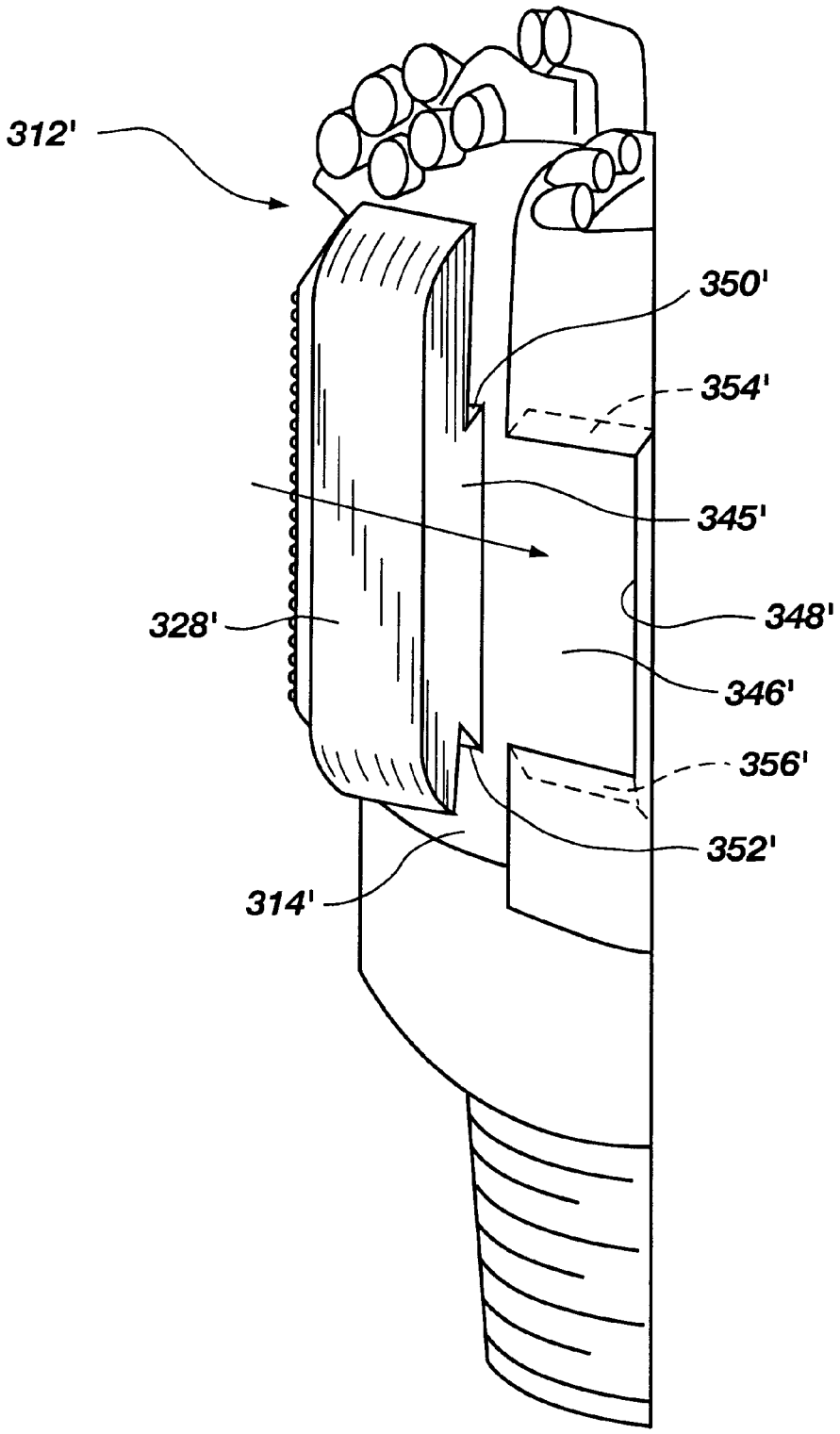
FIG. 13A is a perspective view of a variation of a bit body with a securing element to which the gage pad of FIG. 13 may be secured, depicting the mutual engagement of the cooperating securing elements of the gage pad and the bit body.

With reference to FIG. 13A, the corresponding upper and lower edges of the receptacle of a drill bit with a corresponding securing element are complimentarily tapered. Gage pad 328' may be secured to bit body 312' by inserting an end 345' of securing element 340' into receptacle 346', which is preferably continuous with a junk slot 314' of bit body 312' and sliding gage pad 328' circumferentially relative to bit body 312' until an end 345' of securing element 340' abuts an abutment end 348' of receptacle 346'. The tapered upper edge 350' and lower edge 352' mutually engage complimentarily tapered upper and lower edges 354' and 356', respectively, of receptacle 346'.

Once the securing element of the gage pad has been disposed in the receptacle, in most instances, the gage pad may be affixed to the bit body by mechanical affixation, by brazing, by welding, by the use of adhesives, by the use of bolts, apertures through the gage pad, and receptacles threaded complimentarily to the bolts and formed in the bit body, or by other techniques that are known in the art to secure components to a bit body.

Figure 14A:
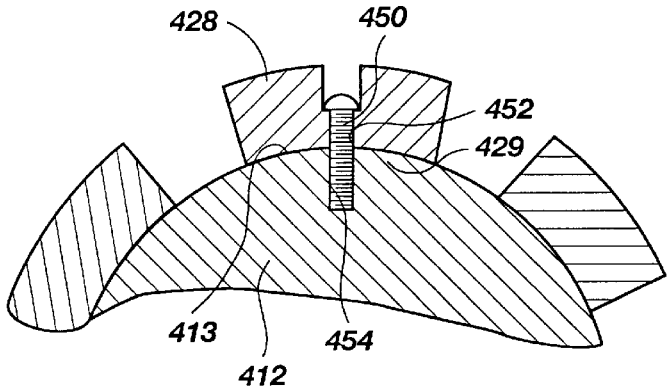
FIGS. 14A and 14B depict a removable gage pad secured to a drill bit by means of a bolt and complimentarily threaded hole in the drill bit.
Figure 14B:
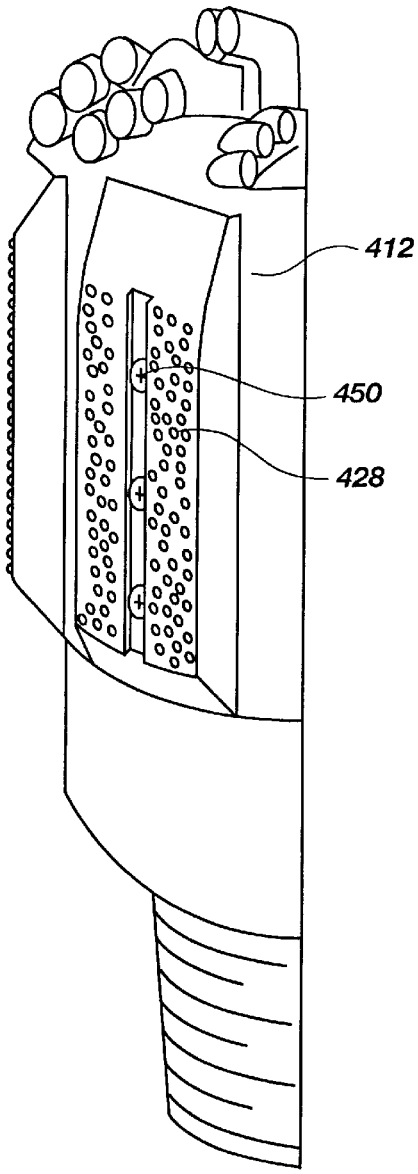

In yet another embodiment, illustrated in FIGS. 14A and 14B, a gage pad 428 according to the present invention may include an abutment surface 429 that is configured complimentarily to a gage pad securing surface 413 of bit body 412. Brazing, welding, adhesives, the use of bolts 450, apertures 452 through gage pad 428, and receptacles 454 threaded complimentarily to the bolts and extending into bit body 412, interference fit, mechanical locking (e.g., by corresponding, interlocking tabs and slots), mechanical affixation, or other techniques that are known in the art to secure components to a bit body may be employed to secure gage pad 428 to bit body 412.

In each of the preceding embodiments, the abutment surface and corresponding surface of the bit body may be textured or otherwise configured with an increased or enhanced surface area relative to that of a flat or smooth surface. Preferably, the surface textures or configurations of the abutment surface and corresponding surface of the bit body complement each other. The enhanced surface area interface created as the abutment surface and corresponding surface of the bit body are biased against one another prevents shearing of the gage pad from the bit body, which may be caused by bending stresses on the gage pad or by normal forces on the gage pad substantially parallel to the interface.

Figure 15:
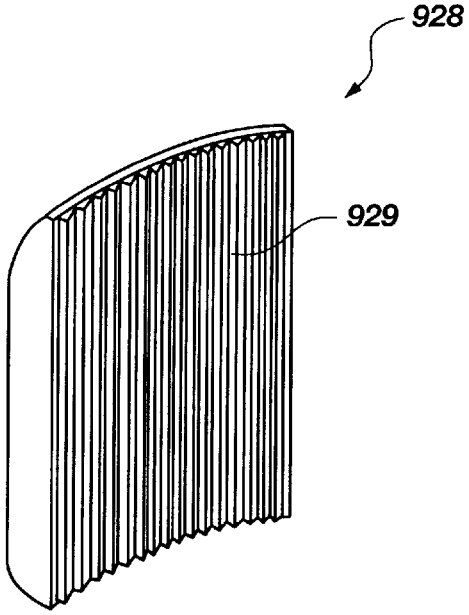
FIG. 15 is a perspective, radially interior view of a gage pad, with an enhanced area abutment surface.
Figure 17:
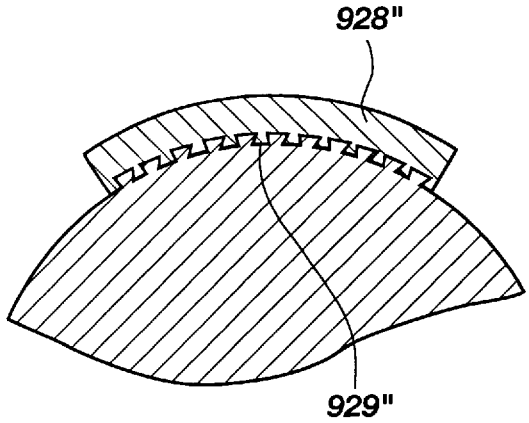
FIG. 17 is a cross section of the gage pad of FIG. 15, with another variation of the enhanced area abutment surface and depicting a complimentarily configured, mutually engaged surface of a drill bit.
Figure 16:
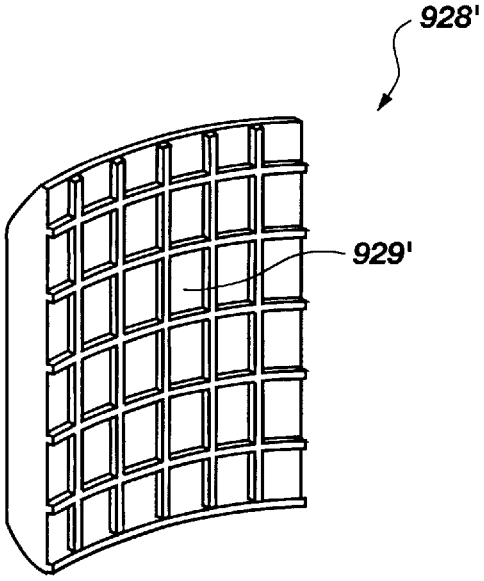
FIG. 16 is a perspective, radially interior view of the gage pad of FIG. 15, with a variation of the enhanced area abutment surface.

Exemplary enhanced surface area interfaces include, without limitation, complementary thread cut (FIG. 15), waffle (FIG. 16), dove-tailed (FIG. 17), dotted, or cross-hatched surfaces; apertures or blind holes and complementary protrusions; heavily sandblasted or otherwise roughened surfaces; or other configurations that increase the mutually-engaging surface areas of the gage pad and the bit body.

Figure 18:
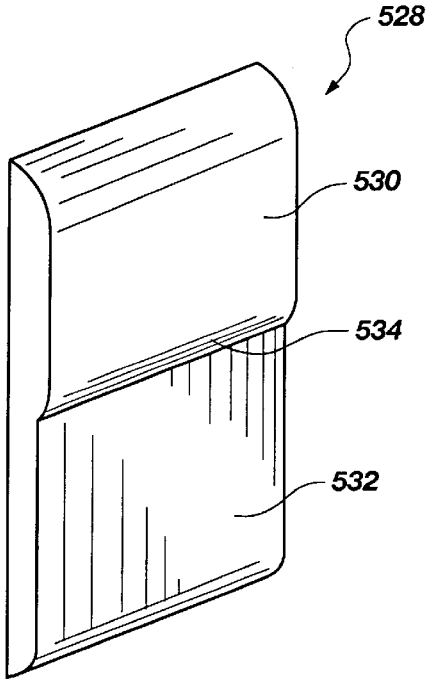
FIGS. 18–20 are perspective exterior views of different configurations of removable gage pads according to the present invention.
Figure 20:
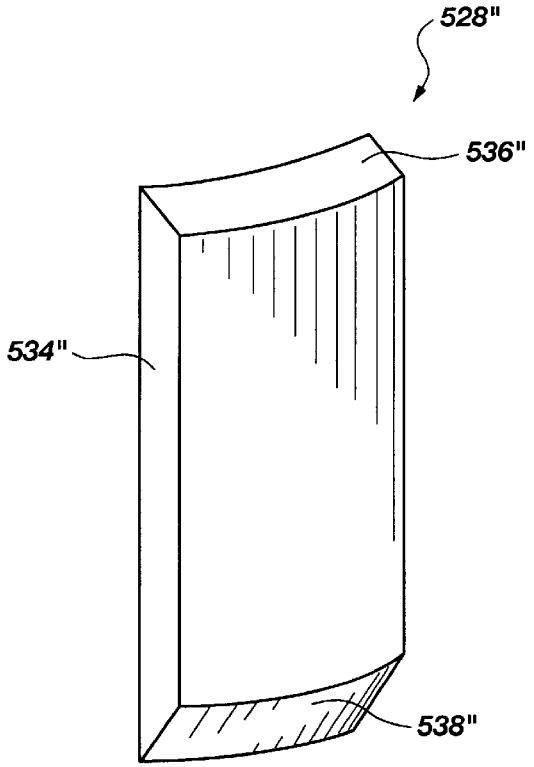
Figure 19:
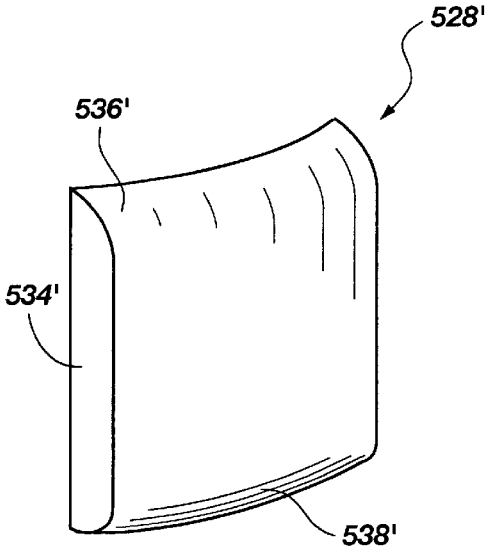

Referring now to FIGS. 18–20, gage pads of various configurations may be secured to a bit body 12 (see FIG. 1). Gage pads of various thicknesses, widths, and lengths may be employed on the bit body. Gage pads may also include different features, such as shoulders between regions of different thickness, and differently sloped or tapered ends.

With reference to FIG. 18, a gage pad 528 is illustrated that includes a thick region 530, a thin region 532, and a shoulder 534 between thick region 530 and thin region 532. FIG. 19 depicts a gage pad 528' that has a substantially uniform thickness throughout the body 534' thereof, and rounded ends 536' and 538'. FIG. 20 shows a longer, narrower gage pad 528" that has a substantially uniform thickness throughout the body 534", which is different from the thickness of body 534' of gage pad 528'. Gage pad 528" also includes tapered ends 536" and 538".

Turning now to FIGS. 21–24, the gage pads of the present invention may include different types of hardfacing, differently plotted hardfaced regions, inserts, or different hardfacing matrices.

Figure 21:
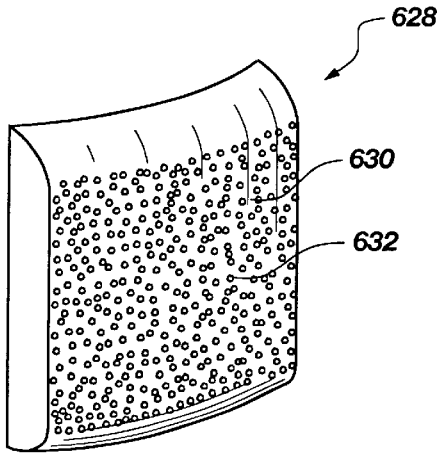
FIGS. 21–23 are perspective exterior views of gage pads including differently patterned hardfacing on the bearing surfaces thereof.
Figure 22:
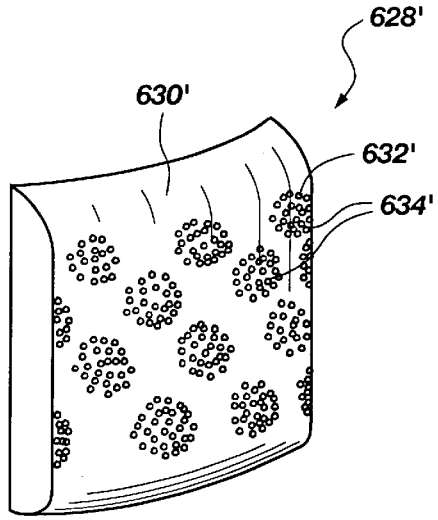

FIG. 21 illustrates a gage pad 628 that includes a so-called "hardfacing" material 632 thereon to impart the bearing surface 630 of gage pad 628 with erosion and abrasion resistance and, thereby, increase the effective useful life of the gage pad. Hardfacing material 632 preferably comprises a hard metal or alloy or other material, such as tungsten carbide, boron nitride, silicon carbide, or any other erosion and abrasion-resistant material that will withstand the conditions to which gage pad 628 is subjected. Hardfacing material 632 may cover substantially the entire bearing surface 630 of gage pad 628, as shown in FIG. 21, or hardfacing material 632' may be applied to select regions 634' of the bearing surface 630' of a gage pad 628', as illustrated in FIG. 22. An exemplary method of applying hardfacing materials to drill bit components, which may be employed in fabricating the removable gage pads of the present invention, is disclosed in U.S. Pat. No. 4,884,477 (hereinafter "the '477 Patent"), which issued to Redd H. Smith et al. on Dec. 5, 1989, the disclosure of which is hereby incorporated by reference in its entirety.

Figure 23:
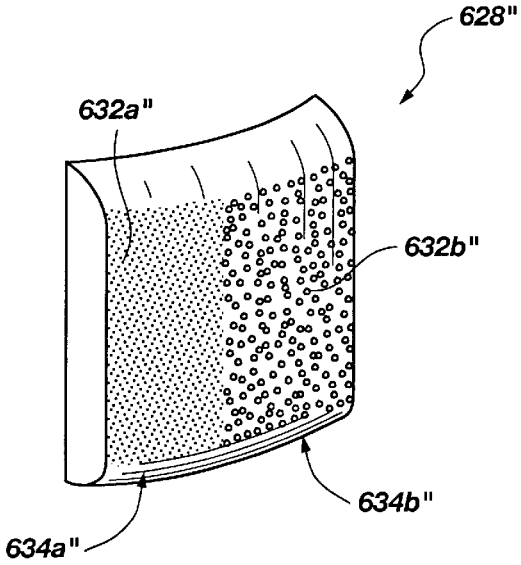

With reference to FIG. 23, in another variation, a hardfaced, replaceable gage pad 628" of the present invention may include regions 634*a*", 634*b*", etc. of different types of hardfacing materials 632*a*", 632*b*", etc. thereon. As disclosed in U.S. Pat. No. 4,726,432, which issued to Danny E. Scott et al. on Feb. 23, 1988, the disclosure of which is hereby incorporated by reference in its entirety, different types of hardfacing materials typically include matrices with different sizes of particles of erosion and abrasion resistant material (e.g., tungsten carbide). As disclosed in the '477 Patent, matrices including finer particles of erosion and abrasion resistant material are typically denser and harder than a hardfacing with a matrix of coarser particles. The binder material and any filler material may also affect the properties of the hardfacing material. Hardfacing materials that are useful on the gage pads of the present invention include known binders, such as nickel- or cobalt-based alloys that may include, without limitation, chromium, iron, boron, and silicon. Other materials that are known in the art to be useful to bind the matrix of the hardfacing material may also be employed.

Figure 24:
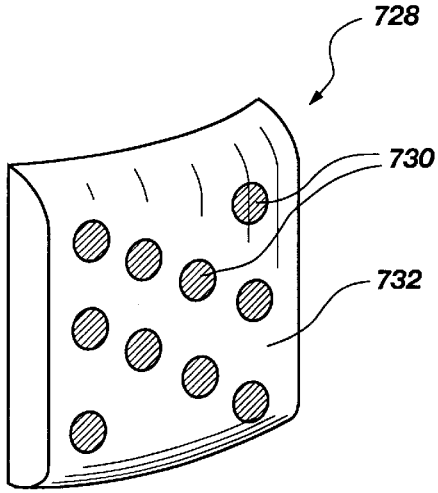
FIG. 24 is a perspective exterior view of a gage pad including hard inserts at the bearing surface thereof.

Turning now to FIG. 24, another embodiment of a replaceable gage pad 728 of the present invention may include hard inserts 730. Exemplary hard inserts 730 that may be employed on gage pad 728 are disclosed in U.S. Pat. Nos. 5,655,612 and 5,467,836, both of which issued to Robert E. Grimes et al., on Aug. 12, 1997 and Nov. 21, 1995, respectively, the disclosures of both of which are hereby incorporated by reference in their entireties. Such hard inserts 730 may be flush with the bearing surface 732 of the gage pad, or protrude from bearing surface 732 to engage the wall of the borehole and, thereby, facilitate the ability of the drill bit to hold gage within the borehole.

Figure 24A:
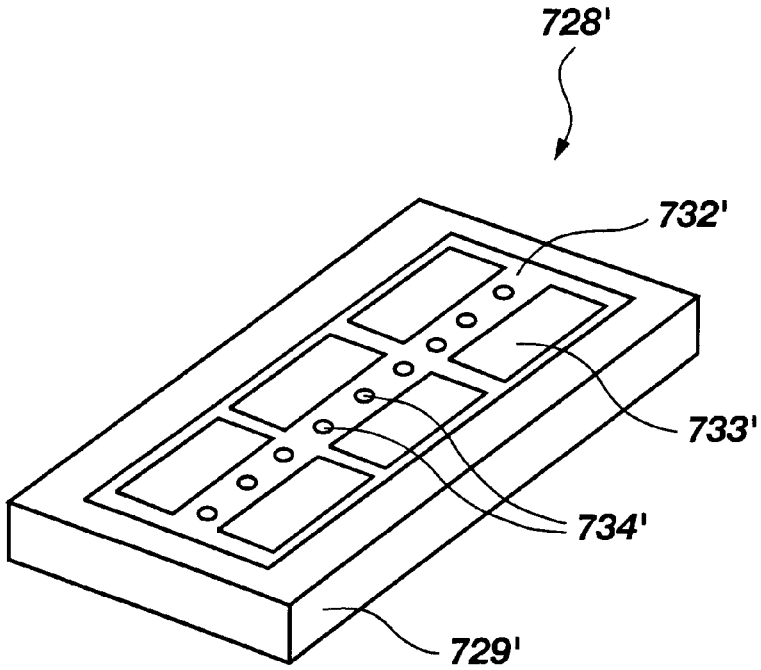
FIGS. 24A and 24B are a perspective exterior view and a cross-sectional view, respectively, of a gage pad including tungsten carbide bricks and diamond inserts at the bearing surface thereof.
Figure 24B:
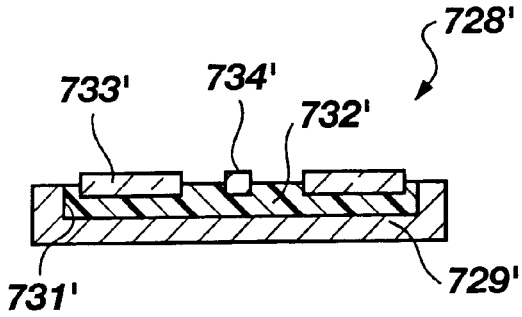

With reference to FIGS. 24A and 24B, a variation of the replaceable gage pad 728' that includes hard inserts is shown. Gage pad 728' includes a gage backing 729' including a receptacle 731' formed in the bearing side thereof. An infiltrated matrix 732' of erosion- and abrasion-resistant material, such as tungsten carbide, is disposed within receptacle 731'. Hard inserts 733' and abrasive structures 734' of an abrasive material are disposed within and exposed at the surface of matrix 732' in any desired arrangement.

Gage backing 729' may be fabricated from steel. Thus, a steel gage backing 729' is particularly useful for securing gage pad 728' to a steel bit body, such as by welding or as otherwise known in the art.

Hard inserts 733' may be fabricated from an erosion- and abrasion resistant material that will withstand the conditions to which a gage pad is exposed during the drilling of a bore hole, such as sintered or hot isostatic pressed (HIP) tungsten carbide. Thus, hard inserts 733' impart gage pad 728' with durability.

The abrasive material of abrasive structures 734' will preferably cut into the formation within which a bore hole is being drilled. Exemplary materials from which abrasive structures 734' may be formed include, without limitation, diamond, polycrystalline diamond (PCD), thermally stable PCD (TSP), or boron nitride. The abrasive material may be coated with a single or multiple layers of metal coatings, as known in the art and disclosed in U.S. Pat. Nos. 4,943,488 and 5,049,164, the disclosures of each of which are hereby incorporated in their entirety by this reference. Such metal coatings are known to increase the strength with which the abrasive material bonds to infiltrated matrix 732'. The abrasive material may be of a substantially uniform particle size, which may be measured in carats or mesh size, or may include particles of various sizes. Similarly, different types of abrasive materials may be employed in abrasive structures 734'.

Hard inserts 733' and abrasive structures 734' may be disposed in the particulate matrix 732' material prior to infiltration. A known infiltrant, such as a nickel-copper alloy, may be employed to infiltrate the particulate material of matrix 732' by known infiltration techniques. As the particulate material of matrix 732' is infiltrated, hard inserts 733' and abrasive structures 734' may be secured to matrix 732'.

The present invention also includes methods of employing the above-described replaceable gage pads. A first method includes testing different types of gage pads with a single drill bit. Referring again to FIG. 3, each of the different types of gage pads 28 includes a securing element 40 that is complimentarily to the corresponding, cooperating securing element 46 of bit body 12. Accordingly, after one or more types of gage pads 28 have been tested, the gage pads may be removed from bit body 12 and replaced with different gage pads 28. As testing of prototype drill bits may not expend the entire useful life of the drill bit, many types of gage pads may be affixed to and tested on a single test bit. Accordingly, many different types of gage pads may be tested, either separately or in combination, without requiring the fabrication of numerous prototype drill bits. Once a gage pad has been tested, the gage pad and the bore hole created by a drill bit carrying the gage pad may each be evaluated as known in the art to determine the effectiveness of the tested gage pads while drilling through specific types of rocks or formations.

Another method includes replacing the gage pads of a drill bit with gage pads of a different type while at the drilling site. When it becomes necessary to replace the gage pads, such as when the drill bit begins drilling a new formation interval of a different type of rock or when the gage pads have worn to the extent that the bit is drilling an undergage bore hole, the drill bit may be removed from the bore hole, and the gage pads removed from the bit body. The gage pads may be removed from the bit body by known techniques, such as by de-brazing any brazing that affixes the gage pads to the bit body, by removing any welds, by loosening and removing any bolts, by softening any adhesive materials, or by releasing any mechanical affixing means.

Next, replacement gage pads of desired specifications may then be secured and affixed to the bit body, preferably by the same means that were employed to affix the old, removed gage pads to the bit body. The drill bit may then be reinserted into the bore hole.

Figure 25:
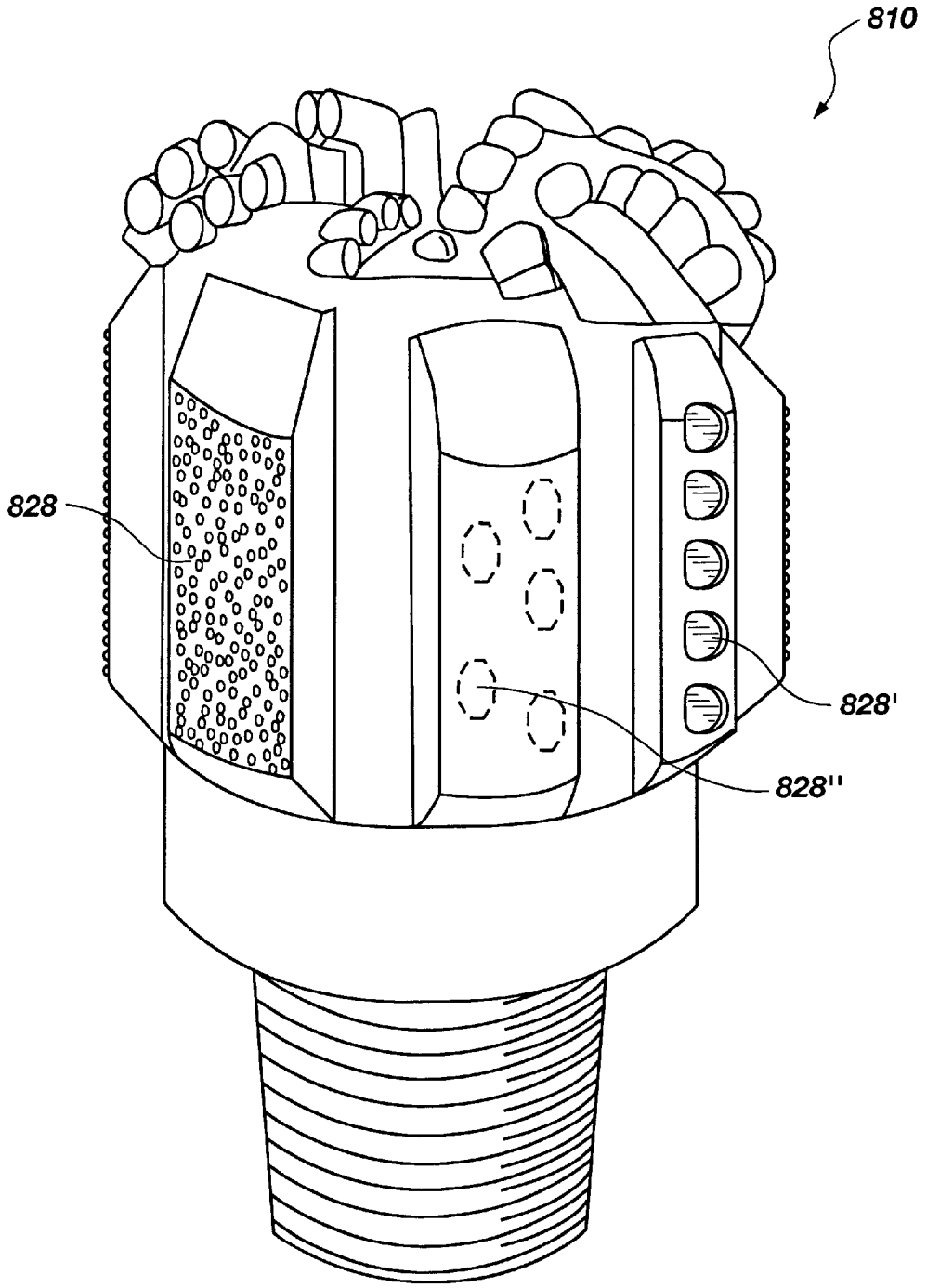
FIG. 25 is a perspective view of an inverted drill bit including a customized combination of removable gage pads thereon.

With reference to FIG. 25, the present invention also includes a method of customizing a drill bit 810, which includes providing a drill bit to which one or more gage pads are attachable, providing one or more gage pads 828, 828', 828", etc. of desired types, and securing and affixing the gage pads 828, 828', 828", etc. to drill bit 810. Accordingly, drill bit 810 may be customized to include one or more desired types of gage pads.

Figure 26:
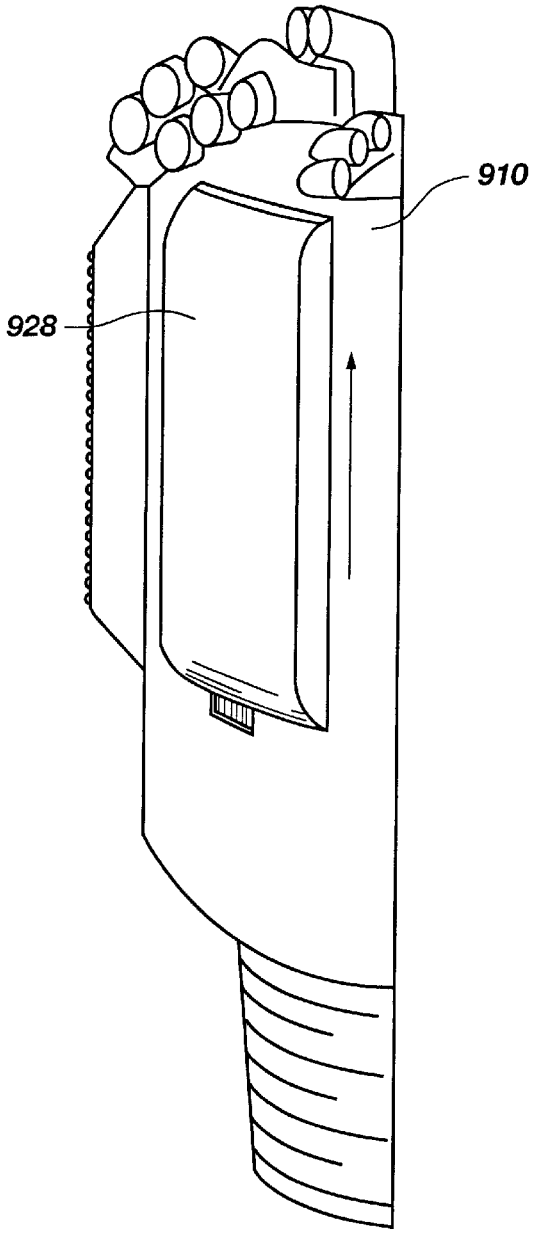
FIGS. 26 and 27 are partial perspective views of drill bits of the present invention that illustrate the replacement of a gage pad with a gage pad of a different mass to alter the balance or net imbalance of the drill bit.
Figure 27:
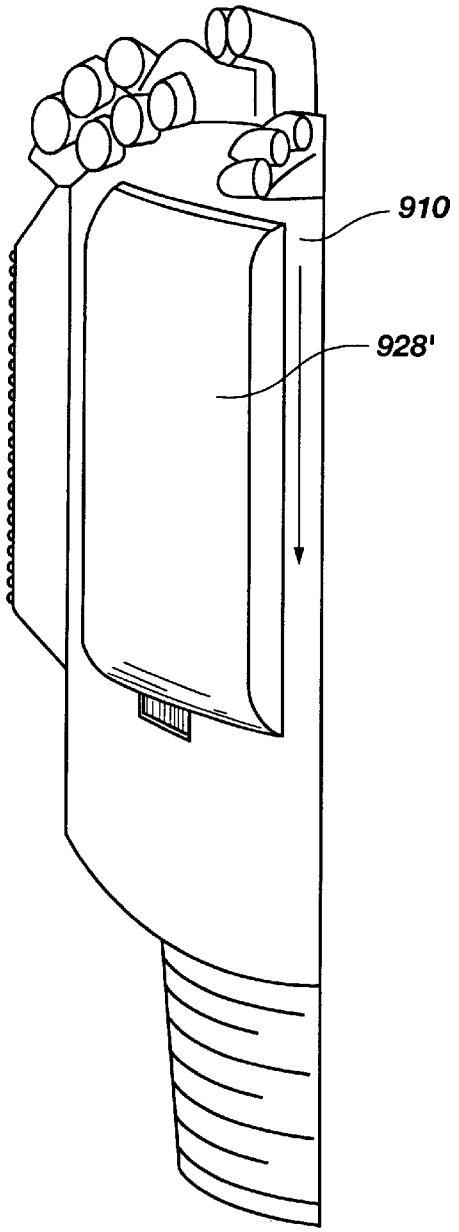

Referring now to FIGS. 26 and 27, another method of the present invention includes altering the balance or net imbalance of a drill bit 910. The method includes removing a replaceable gage pad 928 from drill bit 910 (see FIG. 26), and replacing gage pad 928 with a gage pad 928' having a different mass from that of gage pad 928 (see FIG. 27).

As illustrated in FIGS. 26 and 27, wherein gage pads 928 and 928' are fabricated from the same type of material, the width of gage pad 928', which is greater than the width of gage pad 928, imparts gage pad 928' with a greater mass than that of gage pad 928.

Figure 28:
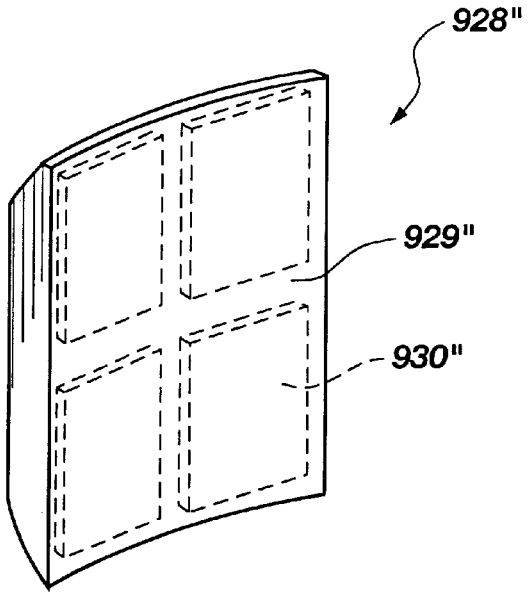
FIG. 28 is a perspective, radially interior view of another embodiment of the gage pad of the present invention, depicting pockets of the gage pad.
Figure 29:
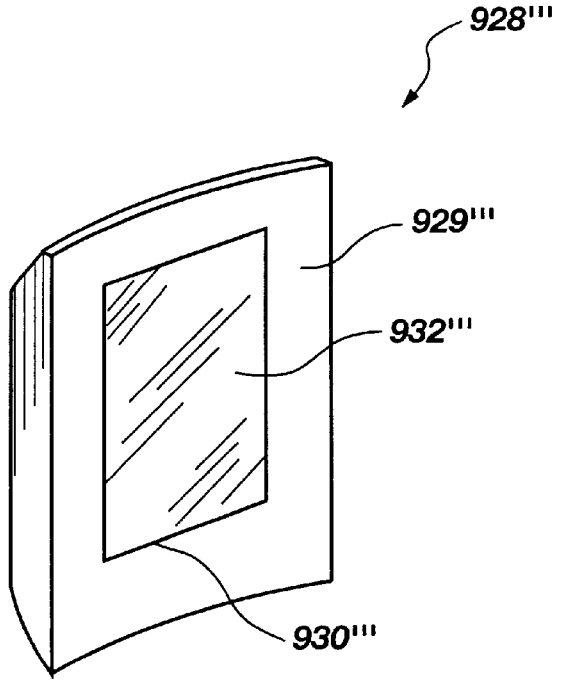
FIG. 29 is a perspective, radially interior view of the gage pad of FIG. 28, depicting weights disposed within the pockets.

Alternatively, with reference to FIGS. 28 and 29, another embodiment of gage pad 928', 928'" may include pockets 930", 930'" comprising a hollow region in the interior of gage pad 928" (pockets 930" of FIG. 28) or a hollow region open to the abutment surface 929'" of gage pad 928'" (pocket 930'" of FIG. 29). Pockets 930', 930" decrease the mass of gage pad 928", 928'" relative to that of a solid gage pad fabricated from the same material. With continued reference to FIGS. 28 and 29, pockets 930", 930'" of gage pad 928", 928'" may be filled with one or more weights 932'". Weights 932''' may comprise a material, such as lead, depleted uranium, etc., that increases the mass of gage pad 928''' relative to that of a solid gage pad.

As another alternative, gage pads of substantially the same size but having different masses may be fabricating by incorporating pores or cells into at least a portion of the gage pad material, such as by the use of ceramic or glass microspheres, by employing known porous casting techniques, or otherwise, as known in the art.

The replaceable gage pads of the present invention may also be employed on other types of earth boring drill bits, such as roller cone bits.

Although the foregoing description contains many specifics, these should not be construed as limiting the scope of the present invention, but merely as providing illustrations of some of the presently preferred embodiments. Similarly, other embodiments of the invention may be devised which do not depart from the spirit or scope of the present invention. Features from different embodiments may be employed in combination. The scope of the invention is, therefore, indicated and limited only by the appended claims and their legal equivalents, rather than by the foregoing description. All additions, deletions and modifications to the invention as disclosed herein which fall within the meaning and scope of the claims are to be embraced thereby.

What is claimed is:

1. A gage pad for an earth boring drill bit, comprising:

a bearing surface;

a bit engagement surface opposite said bearing surface; and a securing element continuous with said bit engagement surface.

2. The gage pad of claim 1, wherein said securing element comprises a protrusion from said bit engagement surface.

3. The gage pad of claim 2, wherein opposing sides of said protrusion each form a substantially acute angle with said bit engagement surface.

4. The gage pad of claim 1, wherein said securing element comprises a plurality of longitudinally aligned protrusions from said bit engagement surface.

5. The gage pad of claim 4, wherein opposing sides of selected ones of said plurality of longitudinally aligned protrusions form a substantially acute angle with said bit engagement surface.

6. The gage pad of claim 1, wherein said securing element comprises a slot formed into said bit engagement surface.

7. The gage pad of claim 6, wherein said slot comprises opposing, non-parallel sides.

8. The gage pad of claim 7, wherein a distance between said opposing, non-parallel sides increases from said bit engagement surface toward said bearing surface.

9. A rotary-type earth boring drill bit, comprising:

a bit body including at least one securing element thereon; and at least one removable gage pad including a cooperating securing element complementary to said at least one securing element and mutually engageable therewith.

10. The drill bit of claim 9, wherein said at least one securing element comprises a slot formed into a surface of said bit body.

11. The drill bit of claim 10, wherein said slot comprises opposing, non-parallel sides.

12. The drill bit of claim 11, wherein a distance between said opposing, non-parallel sides increases from said surface of said bit body toward an interior of said bit body.

13. The drill bit of claim 10, wherein said cooperating securing element comprises a protrusion configured complimentarily to said at least one securing element of said bit body.

14. The drill bit of claim 9, wherein said at least one securing element comprises a plurality of slots formed into a surface of said bit body.

15. The drill bit of claim 14, wherein each of said plurality of slots comprises a receptacle and a retainer.

16. The drill bit of claim 15, wherein said retainer comprises opposing, non-parallel sides.

17. The drill bit of claim 16, wherein a distance between said opposing, non-parallel sides increases from said surface of said bit body toward an interior of said bit body.

18. The drill bit of claim 14, wherein said cooperating securing element of said at least one removable gage pad comprises a plurality of protrusions that each correspond to one of said plurality of slots.

19. The drill bit of claim 18, wherein each of said plurality of protrusions is configured complimentarily to said corresponding one of said plurality of slots.

20. The drill bit of claim 9, wherein said cooperating securing element comprises an elongated protrusion on a bit engagement surface of said at least one removable gage pad.

21. The drill bit of claim 20, wherein said elongated protrusion includes non-parallel opposing sides.

22. The drill bit of claim 21, wherein each of said non-parallel opposing sides forms a substantially acute angle with said bit engagement surface.

23. The drill bit of claim 9, wherein said cooperating securing element comprises a plurality of longitudinally aligned protrusions on a bit engagement surface of said at least one removable gage pad.

24. The drill bit of claim 23, wherein at least a selected one of said plurality of longitudinally aligned protrusions includes non-parallel, opposing sides.

25. The drill bit of claim 24, wherein each of said non-parallel, opposing sides forms a substantially acute angle with said bit engagement surface.

26. The drill bit of claim 9, wherein said at least one securing element comprises a receptacle into which said cooperating securing element of said at least one removable gage pad is insertable.

27. The drill bit of claim 26, wherein said receptacle includes a substantially longitudinally extending abutment end.

28. The drill bit of claim 27, wherein said substantially longitudinally extending abutment end faces in a direction of rotation of the drill bit.

29. The drill bit of claim 9, wherein said cooperating securing element comprises a slot formed into a bit engagement surface of said at least one removable gage pad.

30. The drill bit of claim 29, wherein said slot comprises opposing, non-parallel sides.

31. The drill bit of claim 30, wherein a distance between said opposing, non-parallel sides increases from said bit engagement surface toward a bearing surface of said at least one removable gage pad.

32. The drill bit of claim 29, wherein said at least one securing element comprises a protrusion from a surface of said bit body configured complimentarily to said cooperating securing element of said at least one removable gage pad.

33. The drill bit of claim 32, wherein said at least one securing element comprises a plurality of protrusions that is insertable into said cooperating securing element.

34. The drill bit of claim 9, wherein said at least one securing element comprises an elongated protrusion extending from a surface of said bit body.

35. The drill bit of claim 34, wherein said elongated protrusion includes non-parallel, opposing sides.

36. The drill bit of claim 35, wherein each of said non-parallel, opposing sides forms a substantially acute angle with said surface of said bit body.

37. The drill bit of claim 9, wherein said at least one securing element comprises a plurality of longitudinally aligned protrusions extending from a surface of said bit body.

38. The drill bit of claim 37, wherein at least a selected one of said plurality of longitudinally aligned protrusions includes non-parallel, opposing sides.

39. The drill bit of claim 38, wherein each of said non-parallel, opposing sides forms a substantially acute angle with said surface of said bit body.

40. The drill bit of claim 9, further comprising an affixing element.

41. The drill bit of claim 40, wherein said affixing element comprises brazing.

42. The drill bit of claim 40, wherein said affixing element comprises a weld.

43. The drill bit of claim 40, wherein said affixing element comprises a bolt, an aperture through said at least one removable gage pad, and threading in said bit body complementary to threading of said bolt.

44. A method of testing a plurality of types of gage pads for earth boring drill bits, comprising:

providing a drill bit including at least one securing element at a periphery thereof;

removably affixing at least one first gage pad to said at least one securing element;

drilling a bore hole into a formation with said drill bit;

removing said at least one first gage pad from said drill bit;

removably affixing at least one second gage pad to said drill bit; and evaluating at least one of said at least one first gage pad and said bore hole to determine an effectiveness of said at least one first gage pad in drilling said formation.

45. The method of claim 44, wherein said evaluating comprises evaluating said at least one first gage pad.

46. The method of claim 44, wherein said evaluating comprises evaluating said bore hole.

47. A method of replacing a gage pad on an earth boring drill bit, comprising:

removing a first gage pad from the earth boring drill bit by disengaging at least one securing element of the earth boring drill bit and a complementary securing element of said first gage pad from one another;

positioning a second gage pad on the earth boring drill bit; and affixing said second gage pad to the earth boring drill bit by at least partially mutually engaging at least one securing element of at least one of said gage pad and a cooperating securing element of the earth boring drill bit.

48. The method of claim 47, wherein said removing further comprises loosening a bolt securing said first gage pad to the earth boring drill bit.

49. The method of claim 47, wherein said removing further comprises de-brazing said first gage pad from the earth boring drill bit.

50. The method of claim 47, wherein said removing further comprises removing a weld from said first gage pad.

51. The method of claim 47, wherein said removing further comprises releasing a mechanical locking element.

52. The method of claim 47, wherein said affixing further comprises securing said second gage pad to the earth boring drill bit with a bolt.

53. The method of claim 47, wherein said affixing further comprises brazing said second gage pad to the earth boring drill bit.

54. The method of claim 47, wherein said affixing further comprises welding said second gage pad to the earth boring drill bit.

55. The method of claim 47, wherein said affixing further comprises engaging a mechanical locking element.

56. The method of claim 47, wherein said positioning comprises positioning said second gage pad in substantially the same location from which said first gage pad was removed.

57. The method of claim 47, further comprising removing the earth boring drill bit from a bore hole.

58. The method of claim 47, further comprising placing the earth boring drill bit into a bore hole.

59. A method of customizing an earth boring drill bit, comprising:

selecting a gage pad including a desired configuration, a desired size, and a desired bearing surface;

positioning said gage pad on the earth boring drill bit; and affixing said gage pad to the earth boring drill bit by mutually engaging at least one securing element of said gage pad and a cooperating securing element of the earth boring drill bit.

60. The method of claim 59, further comprising:

selecting another gage pad including another desired configuration, another desired size, and another desired bearing surface;

positioning said another gage pad on the earth boring drill bit; and affixing said another gage pad to the earth boring drill bit.

61. The method of claim 59, wherein said mutually engaging comprises sliding said securing element of said gage pad into said cooperating securing element of the earth boring drill bit.

62. The method of claim 59, wherein said mutually engaging comprises sliding said cooperating securing element of the earth boring drill bit into said securing element of said gage pad.

63. The method of claim 59, wherein said affixing further comprises securing said gage pad to the earth boring drill bit with a bolt.

64. The method of claim 59, wherein said affixing further comprises brazing said gage pad to the earth boring drill bit.

65. The method of claim 59, wherein said affixing further comprises welding said gage pad to the earth boring drill bit.

66. The method of claim 59, wherein said affixing comprises engaging a mechanical locking element.

67. A method of altering a balance or net imbalance of an earth boring drill bit, comprising:

removing a first gage pad from the earth boring drill bit;

positioning a second gage pad having a different mass than a mass of said first gage pad on the earth boring drill bit; and affixing said second gage pad to the earth boring drill bit.

68. The method of claim 67, further comprising changing the mass of said first gage pad and wherein said positioning said second gage pad comprises repositioning said first gage pad on the earth boring drill bit.

* * * * *

UNITED STATES PATENT AND TRADEMARK OFFICE

CERTIFICATE OF CORRECTION

PATENT NO. : 6,260,636 B1
DATED : July 17, 2001
INVENTOR(S) : Cooley et al.

It is certified that error appears in the above-identified patent and that said Letters Patent is hereby corrected as shown below:

Column 1,
Line 41, change "time consuming" to -- time-consuming --;

Column 2,
Line 32, change "complementary" to -- complementarily --;
Lines 43 and 50, change "complimentarily" to -- complementarily --;

Column 3,
Lines 47, 49 and 61, change "cross section" to -- cross-section --;

Column 4,
Lines 14 and 23, change "complimentarily" to -- complementarily --;
Line 22, change "cross section" to -- cross-section --;

Column 5,
Lines 15 and 19, change "complimentarily" to -- complementarily --;
Line 28, after "non-parallel" delete ",";
Line 37, after "cross" insert a hyphen;
Line 50, after "end of" insert -- cooperating --;
Line 57, before "securing" insert -- cooperating --;

Column 6,
Line 2, change "cross section" to -- cross-section --;
Line 13, after "protrusion" insert -- 40*a*´, 40*b*´, 40*c*´, etc. --;
Line 14, change "SO*b*´," to -- 50*b*´, --;
Lines 25, 27, 34, 47 and 59, change "complimentarily" to -- complementarily --;
Line 32, change "29´" to -- 29´´´ --;
Line 42, before "securing" insert -- cooperating --;
Lines 45-46, change "A cooperating securing" to -- Securing --;

Column 7,
Lines 4-5, 13, 29, 44, 49-50 and 53, change "complimentarily" to -- complementarily --;

Column 8,
Line 7, after "cut" insert -- 929 --;
Line 8, after "waffle" insert -- 929´ -- and after "dove-tailed" insert -- 929´´ --;

UNITED STATES PATENT AND TRADEMARK OFFICE

CERTIFICATE OF CORRECTION

PATENT NO. : 6,260,636 B1
DATED : July 17, 2001
INVENTOR(S) : Cooley et al.

It is certified that error appears in the above-identified patent and that said Letters Patent is hereby corrected as shown below:

Column 10,
Line 4, change "complimentarily" to -- complementarily --;
Line 58, change "928′," to -- 928″ --;
Line 62, change "930′, 930″" to -- 930″, 930,‴ --;

Column 11,
Line 5, change "fabricating" to -- fabricated --.
Line 55, delete {indent} so that paragraph aligns with previous indented paragraph beginning on Line 53;

Column 12,
Lines 2-3, 20 and 61, change "complimentarily" to -- complementarily --;

Column 13,
Line 54, after "said" insert -- second --;

Column 14,
Line 37, before "securing" insert -- at least one --; and
Line 42, after "said" insert -- at least one --.

Signed and Sealed this

Seventh Day of May, 2002

*Attest:*

*Attesting Officer*

JAMES E. ROGAN
*Director of the United States Patent and Trademark Office*